US007663616B2

(12) United States Patent
Choi et al.

(10) Patent No.: US 7,663,616 B2
(45) Date of Patent: Feb. 16, 2010

(54) DATA DRIVING CIRCUIT, ORGANIC LIGHT EMITTING DIODE DISPLAY USING THE SAME, AND METHOD OF DRIVING THE ORGANIC LIGHT EMITTING DIODE DISPLAY

(75) Inventors: Sang-Moo Choi, Kyunggi-do (KR); Hong-Kwon Kim, Kyunggi-do (KR); Oh-Kyong Kwon, Seoul (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 753 days.

(21) Appl. No.: 11/313,804

(22) Filed: Dec. 22, 2005

(65) Prior Publication Data

US 2006/0139343 A1 Jun. 29, 2006

(30) Foreign Application Priority Data

Dec. 24, 2004 (KR) ..... 10-2004-0112523

(51) Int. Cl.
*G09G 5/00* (2006.01)

(52) U.S. Cl. ..... 345/204; 345/78

(58) Field of Classification Search ..... 345/76, 345/77, 78, 204, 205, 206, 208, 690
See application file for complete search history.

(56) References Cited

U.S. PATENT DOCUMENTS 7,027,014 B2 * 4/2006 Sato et al. ..... 345/76
7,046,220 B2 * 5/2006 Tagawa et al. ..... 345/76
7,151,536 B2 * 12/2006 Kasai ..... 345/212
7,164,400 B2 * 1/2007 Mizukoshi et al. ..... 345/76
2002/0089357 A1 7/2002 Pae et al.
2003/0218583 A1 11/2003 Hasagawa (Continued)

FOREIGN PATENT DOCUMENTS

CN 1453761 11/2003

(Continued)

OTHER PUBLICATIONS

*Examination Report* from the European Patent Office issued in Applicant's corresponding European Patent Application No. 05 1 12 581.3 dated Aug. 7, 2008.

(Continued)

*Primary Examiner*—Richard Hjerpe
*Assistant Examiner*—Tom V Sheng
(74) *Attorney, Agent, or Firm*—Robert E. Bushnell, Esq.

(57) ABSTRACT

A data driving circuit for displaying an image with a desired brightness comprises: a current digital-analog converter for generating a gradation current corresponding to external data, and for receiving a first current corresponding to the gradation current from a pixel via a data line; a current control unit for receiving a pixel current from the pixel via the data line, and for selectively increasing and decreasing a level of the first current in accordance with the received pixel current; and a selection unit for selectively connecting the data line to either the current digital-analog converter or the current control unit. An organic light emitting diode and a method of driving same are similarly configured. With these configurations, an image is displayed with desired brightness.

39 Claims, 8 Drawing Sheets

U.S. PATENT DOCUMENTS

2006/0038758 A1* 2/2006 Routley et al. ..... 345/81

FOREIGN PATENT DOCUMENTS

| | | |
|---|---|---|
| EP | 0 378 249 | 7/1990 |
| EP | 1 005 013 | 5/2000 |
| JP | 2003-186457 | 7/2003 |
| JP | 2004-004675 | 1/2004 |
| JP | 2004-361888 | 12/2004 |
| WO | WO 03/107313 | 12/2003 |

OTHER PUBLICATIONS

*Office action* from the Japanese Patent Office issued in Applicant's corresponding Japanese Patent Application No. 2005-262132 dated Jun. 24, 2008.

*Office action* from the Patent Office of the P.R. of China issued in Applicant's corresponding Chinese Patent Application No. 200510121570.7 dated Feb. 15, 2008.

European Office Action of the European Patent Application No. 05 11 2581, issued on May 15, 2006.

* cited by examiner

DATA DRIVING CIRCUIT, ORGANIC LIGHT EMITTING DIODE DISPLAY USING THE SAME, AND METHOD OF DRIVING THE ORGANIC LIGHT EMITTING DIODE DISPLAY

CLAIM OF PRIORITY

This application makes reference to, incorporates the same herein, and claims all benefits accruing under 35 U.S.C. §119 from an application for DATA DRIVING CIRCUIT, ORGANIC LIGHT EMITTING DIODE DISPLAY USING THE SAME, AND METHOD OF DRIVING THE ORGANIC LIGHT EMITTING DIODE DISPLAY earlier filed in the Korean Intellectual Property Office on 24 of Dec., 2004 and there duly assigned Serial No. 2004-112523.

BACKGROUND OF THE INVENTION

1. Technical Field

The present invention relates to a data driving circuit, an organic light emitting diode display using the same, and a method of driving the organic light emitting diode display, and more particularly, to a data driving circuit for displaying an image with desired brightness, an organic light emitting diode display using the same, and a method of driving the organic light emitting diode display.

2. Related Art

Various flat panel displays have recently been developed as alternatives to the relatively heavy and bulky cathode ray tube (CRT) display. Flat panel displays include a liquid crystal display (LCD), a field emission display (FED), a plasma display panel (PDP), an organic light emitting diode display (OLED), etc.

Among the flat panel displays, the organic light emitting diode display can emit light for itself by electron-hole recombination. Such an organic light emitting diode display has advantages in that response time is relatively fast and power consumption is relatively low. Generally, the organic light emitting diode display employs a transistor provided in each pixel for supplying current corresponding to a data signal to a light emitting device, thereby causing the light emitting device to emit light.

An organic light emitting diode display comprises a pixel portion including a plurality of pixels formed in a region defined by intersection of scan lines and data lines, a scan driver for driving the scan lines, a data driver for driving the data lines, and a timing controller for controlling the scan driver and the data driver.

The timing controller generates a data control signal and a scan control signal corresponding to an external synchronization signal. The data control signal and the scan control signal are supplied from the timing controller to the data driver and the scan driver, respectively. Furthermore, the timing controller supplies external data to the data driver.

The scan driver receives the scan control signal from the timing controller. The scan driver generates scan signals on the basis of the scan control signal and supplies the scan signals to the scan lines.

The data driver receives the data control signal from the timing controller. The data driver generates data signals on the basis of the data control signal and supplies the data signals to the data lines while synchronizing with the scan signals.

The display portion receives first power and second power from an external power source, and supplies them to the respective pixels. When the first power and the second power are applied to the pixels, each pixel controls a current corresponding to the data signal to flow from a first power line to a second power line via the light emitting device, thereby emitting light corresponding to the data signal.

That is, in the organic light emitting diode display, each pixel emits light with a predetermined brightness corresponding to the data signal, but cannot emit light with desired brightness because transistors provided in the respective pixels are different in threshold voltage from each other. Furthermore, in the organic light emitting diode display, there is no method of measuring and controlling a real current flowing in each pixel in correspondence to the data signal.

SUMMARY OF THE INVENTION

Accordingly, it is an aspect of the present invention to provide a data driving circuit for displaying an image with desired brightness, an organic light emitting diode display using the same, and a method of driving the organic light emitting diode display.

The foregoing and/or other aspects of the present invention are achieved by providing a data driving circuit comprising: a current digital-analog converter for generating a gradation current corresponding to external data, and for receiving a first current corresponding to the gradation current from a pixel via a data line; a current control unit for receiving a pixel current from the pixel via the data line, and for increasing or decreasing a level of the first current in accordance with the received pixel current; and a selection unit for selectively connecting the data line with either the current digital-analog converter or the current control unit.

According to an aspect of the invention, the selection unit connects the data line to the current digital-analog converter for a first period of a horizontal period, and alternately connects the data line between the current digital-analog converter and the current control unit for a second period of the horizontal period excluding the first period. Furthermore, the selection unit connects the current control unit to the current digital-analog converter when the data line is connected to the current control unit. In this regard, the selection unit comprises a plurality of selectors, each selector comprising: first and second transistors connected between the data line and the current digital-analog converter; a third transistor connected between the data line and the current control unit; and a fourth transistor connected between the current control unit and the current digital-analog converter. For the first period, the first and second transistors are turned on, and the third and fourth transistors are turned off. For the second period, the third and fourth transistors are turned off when the first and second transistors are turned on, and the first and second transistors are turned off when the third and fourth transistors are turned on. Preferably, the first current flows in the pixel when the first and second transistors are turned on for the first period, and a current increased or decreased from the first current flows in the pixel when the first and second transistors are turned on for the second period.

Other aspects of the present invention are achieved by providing an organic light emitting diode display comprising: a plurality of first and second scan lines; a plurality of data lines intersecting the first and second scan lines; a pixel portion including a plurality of pixels connected to the first and second scan lines and the data line; a scan driver for supplying first and second scan signals to the first and second scan lines, respectively; and a data driver connected to the data line and receiving a first current corresponding to a gradation current as a data signal from the pixels. The data driver receives a pixel current flowing in each pixel corresponding to the first current, and increases or decreases a level of the first current in accordance with the received pixel current.

According to another aspect of the invention, each pixel comprises: a light emitting device; a driver for generating the pixel current corresponding to the first current; a first transistor connected between the driver and the data line, and controlled by a first scan signal supplied through the first scan line; and a second transistor connected between the data line and a common node formed between the driver and the light emitting device, and controlled by a second scan signal supplied through the second scan line. In this case, the first transistor is turned on in correspondence to the first scan signal for a first period of a predetermined horizontal period, and turned on and off at least once in a second period of the horizontal period excluding the first period. Furthermore, the second transistor is turned in correspondence to the second scan signal for the predetermined horizontal period.

Still another aspect of the present invention is achieved by providing a method of driving an organic light emitting diode display, comprising the steps of: (a) generating a gradation current corresponding to data; (b) receiving a first current corresponding to the gradation current from a pixel; (c) receiving a pixel current corresponding to the first current from the pixel; (d) comparing the gradation current to the pixel current; and (e) increasing or decreasing a level of the first current on the basis of the comparison result of step (d).

According to an aspect of the invention, the method further comprises the steps of: (f) receiving the first current increased or decreased in step (e) from the pixel; and (g) receiving a pixel current corresponding to the increased or decreased first current from the pixel. In step (e), the first current is increased or decreased so as to equalize the pixel current with the gradation current. Preferably, steps (d) thru (g) are repeated at least once.

Yet another aspect of the present invention is achieved by providing a method of driving an organic light emitting diode display, comprising the steps of: (a) generating a gradation current corresponding to data; (b) receiving a first current corresponding to the gradation current from a pixel during a first period; (c) receiving a pixel current corresponding to the first current from the pixel during a second period excluding the first period; (d) comparing the gradation current to the pixel current; and (e) increasing or decreasing a level of the first current on the basis of the comparison result of step (d).

According to an aspect of the invention, the method further comprises the steps of: (f) receiving the first current increased or decreased in step (e) from the pixel; and (g) receiving a pixel current corresponding to the increased or decreased first current from the pixel. In step (e), the first current is increased or decreased to equalize the pixel current with the gradation current. Preferably, steps (d) thru (g) are repeated at least once during the second period.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, preferable embodiments according to the present invention will be described with reference to the accompanying drawings, wherein the preferred embodiments of the present invention are provided so as to be readily understood by those skilled in the art.

Figure 1:
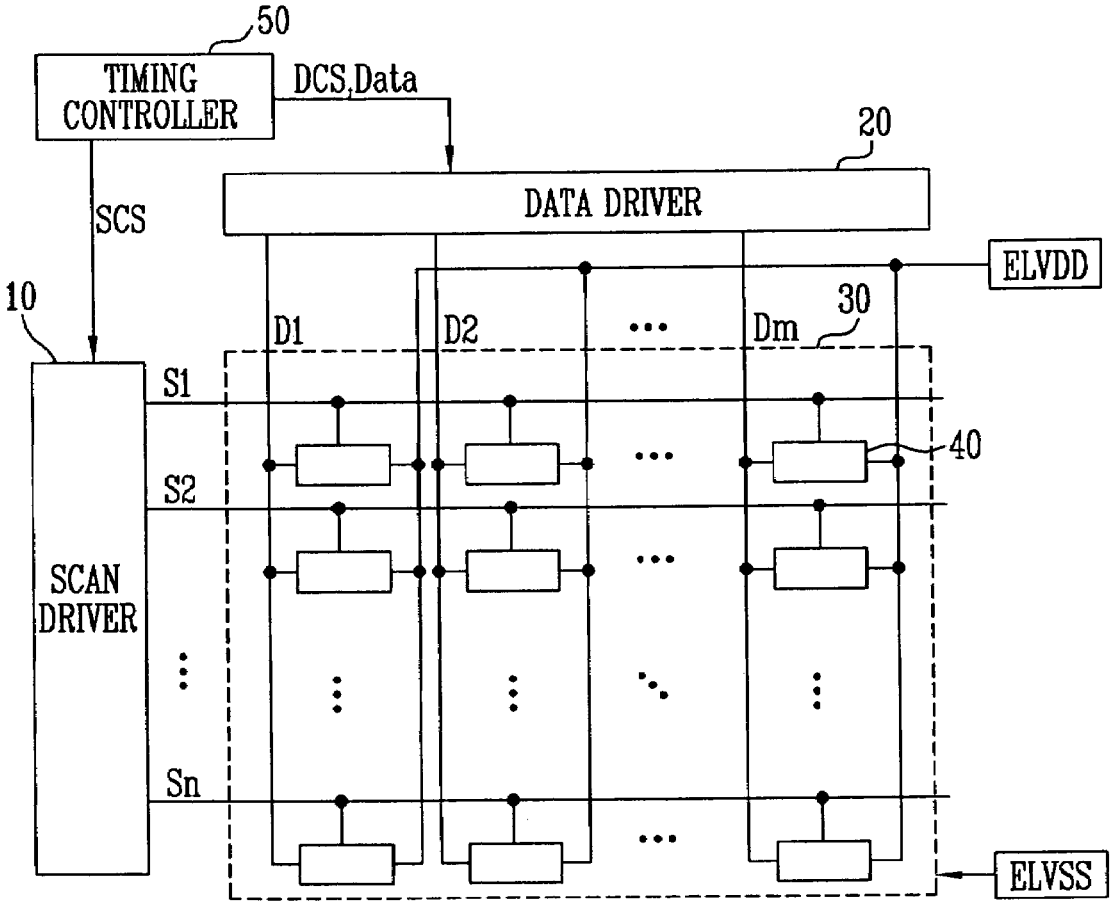
FIG. 1 illustrates an organic light emitting diode display.

FIG. 1 illustrates an organic light emitting diode display.

Referring to FIG. 1, an organic light emitting diode display comprises: a pixel portion 30 including a plurality of pixels 40 formed in a region defined by the intersection of scan lines S1 thru Sn and data lines D1 thru Dm; a scan driver 10 for driving the scan lines S1 thru Sn; a data driver 20 for driving the data lines D1 thru Dm; and a timing controller 50 for controlling the scan driver 10 and the data driver 20.

The timing controller 50 generates a data control signal DCS and a scan control signal SCS corresponding to an external synchronization signal. The data control signal DCS and the scan control signal SCS are supplied by the timing controller 50 to the data driver 20 and the scan driver 10, respectively. Furthermore, the timing controller 50 supplies external data to the data driver 20.

The scan driver 10 receives the scan control signal SCS from the timing controller 50. The scan driver 10 generates scan signals on the basis of the scan control signal SCS, and 20 supplies the scan signals to the scan lines S1 thru Sn.

The data driver 20 receives the data control signal DCS from the timing controller 50. The data driver 20 generates data signals on the basis of the data control signal DCS, and supplies the data signals to the data lines D1 thru Dm while synchronizing with the scan signals.

The display portion 30 receives first power ELVDD and second power ELVSS from an external power source, and supplies them to the respective pixels 40. When the first power ELVDD and the second power ELVSS are applied to the pixels 40, each pixel 40 controls a current corresponding to the data signal so that it flows from a first power line ELVDD to a second power line ELVSS via the light emitting device, thereby emitting light corresponding to the data signal.

Figure 2:
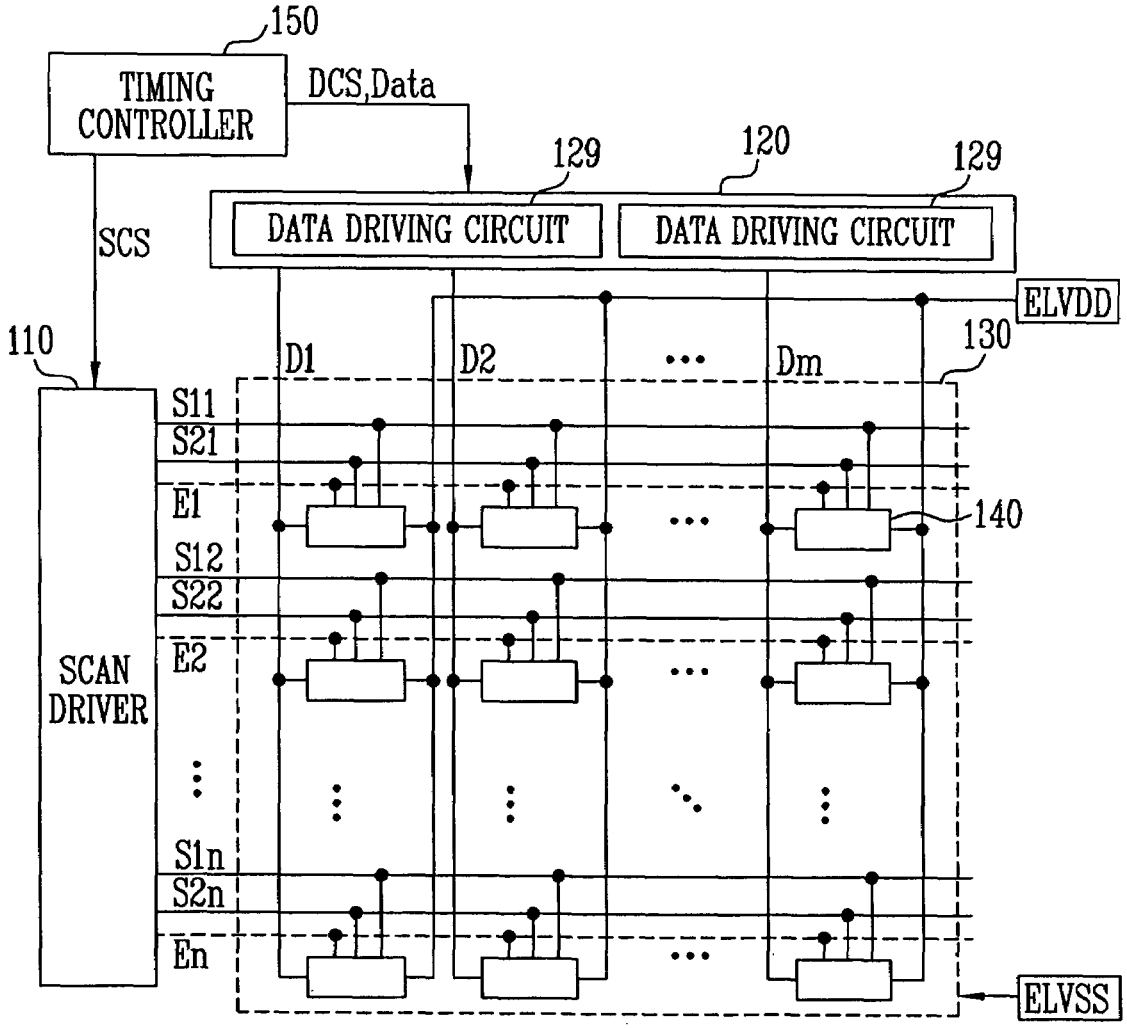
FIG. 2 illustrates an organic light emitting diode display according to an embodiment of the present invention.

FIG. 2 illustrates an organic light emitting diode display according to an embodiment of the preset invention.

Referring to FIG. 2, an organic light emitting diode display according to an embodiment of the present invention comprises: a pixel portion including a plurality of pixels 140 formed in regions defined by first scan lines S11 thru S1*n*, second scan lines S21 thru S2*n*, emission control lines E1 thru En, and data lines D1 thru Dm; a scan driver 110 for driving the first scan lines S11 thru S1*n*, the second scan lines S21 thru S2*n*, and the emission control lines E1 thru En; a data driver for driving the data lines D1 thru Dm; and a timing controller 150 for controlling the scan driver 110 and the data driver 120.

Figure 3:
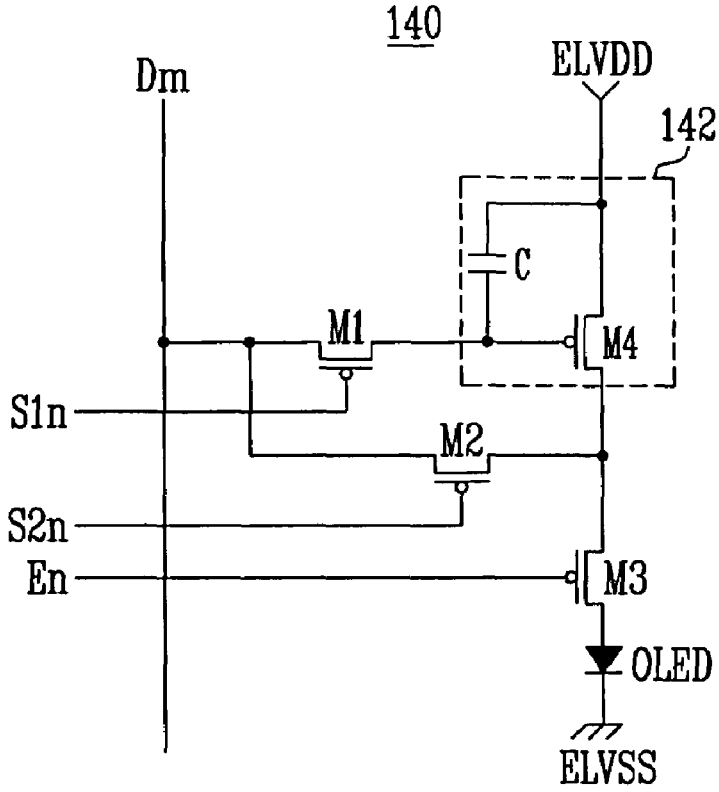
FIG. 3 is a circuit diagram of the pixel illustrated in FIG. 2.

The pixel portion 130 comprises the plurality of pixels 140 formed in regions defined by the first scan lines S11 thru S1*n*, the second scan lines S21 thru S2*n*, the emission control lines E1 thru En, and the data lines D1 thru Dm. The pixels 140 receive external first power ELVDD and second power ELVSS. When the first power ELVDD and the second power ELVSS are applied to the pixels 140, each pixel 140 controls a pixel current to flow from a first power line ELVDD to a second power line ELVSS via a light emitting device in correspondence to a data signal transmitted through the data line D. Furthermore, the pixel 140 supplies the pixel current to the data driver 120 via the data line D for a partial horizontal period. Thus, each pixel 140 is configured as shown in FIG. 3, which will be described later.

The timing controller 150 generates a data control signal DCS and a scan control signal SCS in response to external synchronization signals. The timing controller 150 supplies the data control signal DCS and the scan control signal SCS to the data driver 120 and the scan driver 110, respectively. Furthermore, the timing controller 150 supplies external data Data to the data driver 120.

The scan driver 110 receives the scan control signal SCS from the timing controller 150. In response to the scan control signal SCS, the scan driver 110 sequentially supplies first scan signals to the first scan lines S11 thru S1*n*, and at the same time sequentially supplies second scan signals to the second scan lines S21 thru S2*n*.

Figure 4:
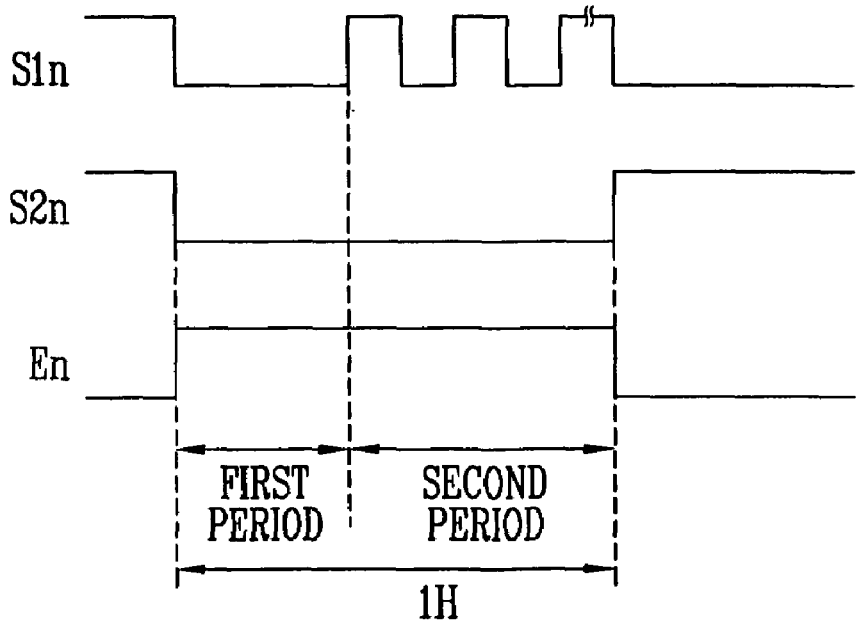
FIG. 4 shows waveforms of signals for driving the pixel illustrated in FIG. 3.

As shown in FIG. 4, the scan driver 110 supplies a first scan signal to turn on a first transistor M1 provided in the pixel 140 for a first period of a predetermined horizontal period, and to alternately turn on and off the first transistor M1 at least once during a second period of the horizontal period. Furthermore, the scan driver 110 supplies a second scan signal to turn on a second transistor M2 provided in the pixel 140 during a predetermined horizontal period. Also, the scan driver 110 supplies an emission control signal to turn off a third transistor M3 provided in the pixel 140 during a predetermined horizontal period during which the first and second scan signals are supplied, and to turn on the third transistor M3 during the other period. According to an embodiment of the present invention, the emission control signal is supplied so as to overlap with the first and second scan signals, and has a width equal to or larger than that of the second scan signal.

The data driver 120 receives the data control signal DCS from the timing controller 150. Then, the data driver 120 generates the data signal in response to the data control signal DCS, and receives the data signal through the data lines D1 thru Dm. In this regard, the data driver 120 is configured as a current sink type device. In other words, the data driver 120 receives a current corresponding to a gradation current as the data signal from the pixel 140.

In the latter regard, the data driver 120 receives a pixel current from the pixel 140 during a partial second period of each horizontal period, during which the first transistor M1 is turned off, and determines whether the pixel current corresponds to the gradation current. For example, when a gradation current of 10 μA is generated in correspondence to a bit value (or gradation level) of the data Data, the data driver 120 determines whether the pixel current received from the pixel 140 is 10 μA. When the data driver 120 receives an undesired current from each pixel 140, the data driver 120 increases or decreases a current which is supplied to the data line D, thereby allowing a desired current to flow in each pixel 140. In this respect, the data driver 120 comprises at least one data driving circuit 129 having j channels (where, j is a natural number). Detailed configuration of the data driving circuit 129 will be described later.

FIG. 3 is a circuit diagram of the pixel illustrated in FIG. 2. For the sake of convenience, FIG. 3 illustrates in exemplary fashion a pixel that is connected to the mth data line Dm, the nth first scan line S1*n*, the nth second scan line S2*n*, and the nth emission control line En.

Referring to FIG. 3, the pixel 140 according to an embodiment of the present invention comprises a first transistor M1, a second transistor M2, a third transistor M3 and a driver 142.

The first transistor M1 is connected between the data line Dm and a driver 142, thereby electrically connecting the data line Dm to the driver 142. The first transistor M1 is controlled by the first scan signal transmitted to the nth first scan line S1*n*.

The second transistor M2 is connected between a data line Dm and a common node between the driver 142 and the light emitting device OLED, thereby electrically connecting the data line Dm to the driver 142. The second transistor M2 is controlled by the second scan signal transmitted to the nth second scan line S2*n*.

The third transistor M3 is connected between the driver 142 and the light emitting device OLED. The third transistor M3 is controlled by the emission control signal transmitted to the nth emission control line En. At this point, the emission control signal is supplied so as to overlap with the first and second scan signals respectively supplied to the mth first and second scan lines S1*n* and S2*n*. The third transistor M3 is turned off while the emission control signal is supplied, and is turned on while the emission control signal is not supplied.

The driver 142 supplies the pixel current to the second transistor M2 and the third transistor M3 in correspondence to the data signal (sink current) received from the first transistor M1. In this regard, the driver 142 comprises a capacitor C to be charged with voltage corresponding to the data signal, and a fourth transistor M4 for supplying a pixel current corresponding to the voltage charged in the capacitor C. Alternatively, the driver 142 is not limited to the configuration shown in FIG. 3, and may comprise one of various well-known circuits used for the current sink type configuration. Also, the transistors M1 thru M4 illustrated in FIG. 3 are illustrated as p-channel metal oxide semiconductor (PMOS) transistors, but are not limited thereto.

Referring to FIGS. 3 and 4, the pixel 140 operates as follows.

For a predetermined horizontal period of one frame, the first scan signal is supplied through the nth first scan line S1*n*, and at the same time, the second scan signal is supplied through the nth second scan line S2*n*.

The second scan signal of the nth second scan line S2*n* is supplied to the second transistor M2, so that the second transistor M2 is turned on for the predetermined horizontal period.

The first scan signal of the nth first scan line S1*n* is supplied to the first transistor M1. At this point, the first transistor M1 is turned on during the first period of the predetermined horizontal period. For the first period, both the first transistor M1 and the second transistor M2 are turned on, so that the data line Dm, the first transistor M1, the driver 142, and the second transistor M2 are connected as a current path. Then, a current corresponding to the data signal is supplied from the pixel 140 to the data driver 120. Substantially, the data driver 120 receives the current corresponding to the gradation current from the pixel 140. At this point, the capacitor C provided in the driver 142 is charged with the voltage corresponding to the data signal. That is, for the first period, the capacitor C is charged with a voltage corresponding to the sink current (data signal) flowing toward the data driver 120. Thereafter, the first transistor M1 is turned off at least once during the second period. When the first transistor M1 is turned off, the pixel current corresponding to the voltage charged in the capacitor C is supplied from the driver 142 to the data driver 120 via the second transistor M2 and the data line Dm. Thus, the data driver 120 receives the pixel current from the driver 142, and increases or decreases the current supplied to the data line Dm, thereby allowing a desired pixel current to flow in the pixel 140.

Thereafter, when the first transistor M1 is turned on during the second period, the capacitor C is charged with a voltage corresponding to the current increased or decreased by the data driver 120. Substantially, the first transistor M1 is turned on and off at least once during the second period, so that the voltage charged in the capacitor C is controlled so as to allow the desired current to flow in the pixel 140.

In the meantime, the emission control signal is supplied to the nth emission control line En during the predetermined horizontal period, so that the third transistor M3 is turned off. Therefore, pixel current is not supplied to the light emitting device OLED. Then, the emission control signal is not supplied to the nth emission control line En after the lapse of the predetermined horizontal period, so that pixel current is supplied to the light emitting device OLED. In this case, the pixel current is adjusted to a desired current during the predetermined horizontal period, so that the light emitting device OLED can emit light with a desired brightness.

Figure 5:
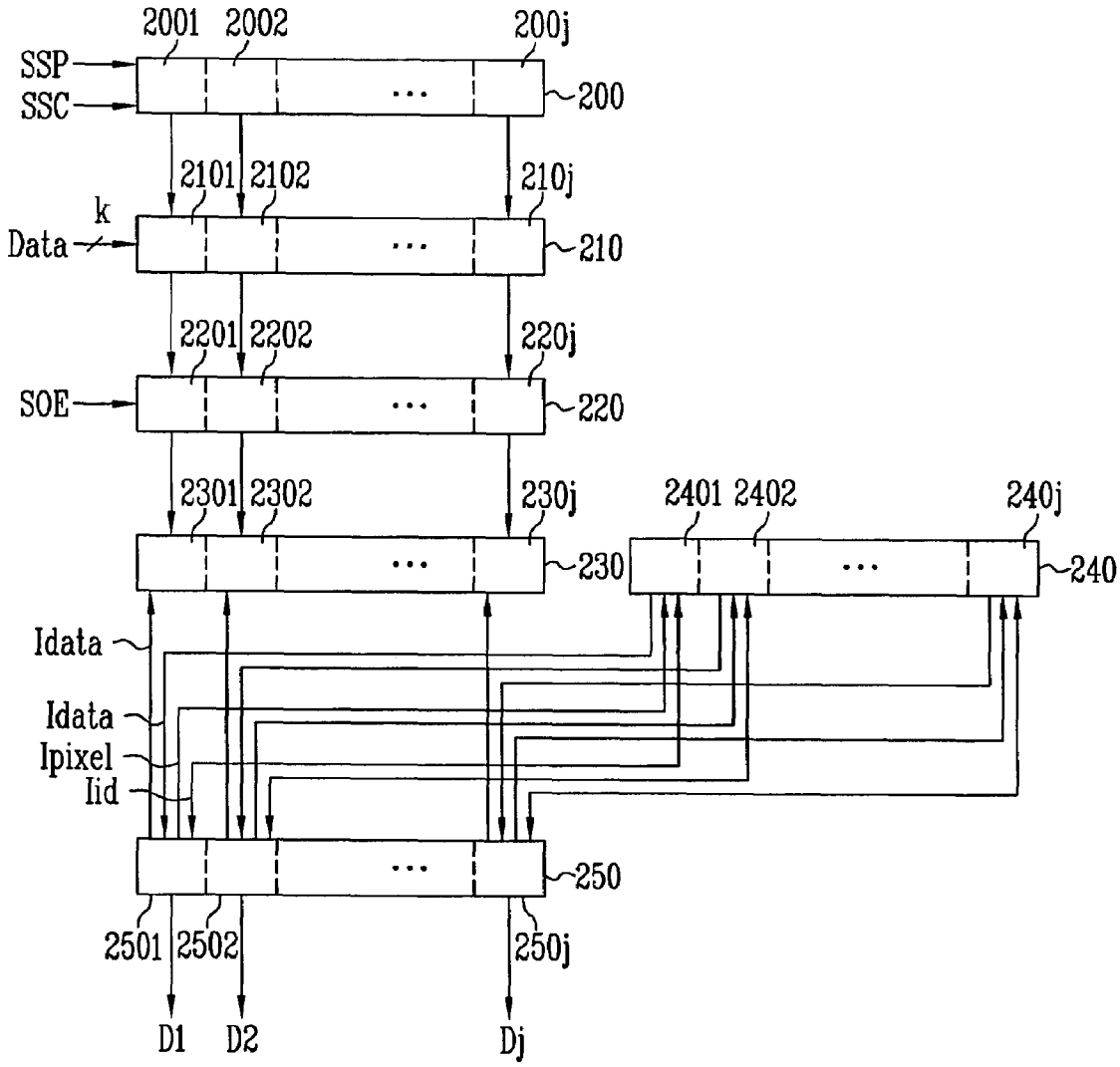
FIG. 5 is a block diagram of an embodiment of the data driving circuit illustrated in FIG. 2.

FIG. 5 is a block diagram showing an embodiment of the data driving circuit illustrated in FIG. 2. For the sake of convenience, FIG. 5 illustrates in exemplary fashion a pixel integrated circuit 129 having j channels.

Referring to FIG. 5, the data driving circuit 129 comprises: a shift register part 200 for generating sampling signals in sequence; a sampling latch part 210 for storing the data Data in sequence in response to the sampling signals; a holding latch part 220 for temporarily storing the data Data of the sampling latch part 210 and for supplying the stored data Data to a current digital-analog converter (IDAC) 230; the IDAC 230 for generating the gradation current Idata corresponding to a gradation level of the data Data; a current control unit 240 for controlling a current supplied from the pixel 140 in correspondence to the pixel current Ipixel; and a selection unit 250 for supplying the pixel current Ipixel from the pixel 140 to the current control unit 240 for a part of the horizontal period.

The shift register part 200 receives a source shift clock SSC and a source start pulse SSP from the timing controller 150, and shifts the source start pulse SSP per period of the source shift clock SSC, thereby generating j sampling signals in sequence. The shift register part 200 comprises j shift registers 2001 thru 200*j*.

The sampling latch part 210 stores the data Data therein in sequence in response to the sampling signals sequentially supplied by the shift register part 200. The sampling latch part 210 comprises j sampling latches 2101 thru 210*j* for storing j data Data therein. Furthermore, the size of each of the sampling latches 2101 thru 210*j* corresponds to a bit value of the data Data. For example, when the data Data is k bits in length, each of the sampling latches 2101 thru 210*j* has a size corresponding to k bits.

The holding latch part 220 receives the data Data from the sampling latch part 210 and stores it therein in response to a source output enable signal SOE. Furthermore, the holding latch part 220 supplies the data Data stored therein to the IDAC 230 in response to the source output enable signal SOE. The holding latch part 220 comprises j holding latches 2201 thru 220*j*, each being k bits in size.

The IDAC 230 generates the gradation current Idata corresponding to the bit value of the data Data, and receives a current as high as the generated gradation current Idata from the pixel 140 via the data line D. That is, the IDAC 230 sinks the current as high as the gradation current Idata corresponding to the bit value of the data Data. The IDAC 230 comprises j current generators 2301 thru 230*j*.

The current control unit 240 receives the gradation current Idata and the pixel current Ipixel, and compares the gradation current Idata with the pixel current Ipixel, thereby controlling a current supplied to the pixel 140 on the basis of the difference between the gradation current Idata and the pixel current Ipixel. Substantially, the current control unit 240 controls the current so as to make a desired pixel current Ipixel flow in the pixel 140. The current control unit 240 comprises j current controllers 2401 thru 240*j*.

The selection unit 250 connects the IDAC 230 to the data lines D1 thru Dm during a first period of the horizontal period. When the IDAC 230 is connected to the data lines D1 thru Dm, current corresponding to the gradation current Idata flows from the pixels 140 to the IDAC 230. Furthermore, the selection unit 250 connects the data lines D1 thru Dm to the current control unit 240 during a partial second period. When the data lines D1 thru Dm are connected to the current control unit 240, the pixel current Ipixel flows from the pixels 140 to the current control unit 240. The selection unit 250 comprises j selectors 2501 thru 250*j*.

Figure 6:
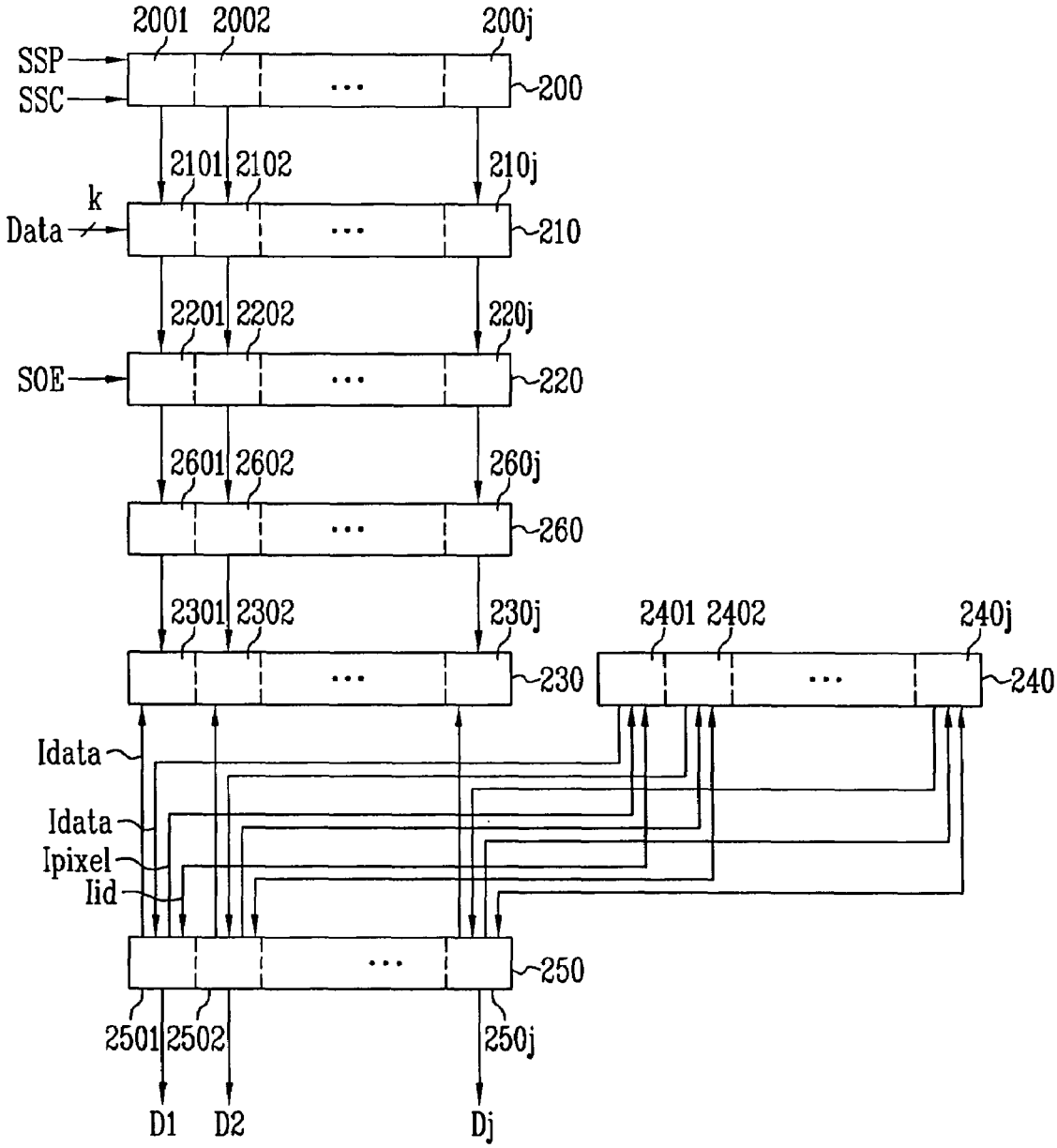
FIG. 6 is a block diagram of another embodiment of the data driving circuit illustrated in FIG. 2.

FIG. 6 is a block diagram of another embodiment of the data driving circuit illustrated in FIG. 2.

According to this embodiment of the present invention, as shown in FIG. 6, the data driving circuit 129 further comprises a level shifter part 260 disposed between the holding latch part 220 and the IDAC 230. The level shifter part 260 increases the voltage level of the data Data supplied by the holding latch part 220, and supplies it to the IDAC 230. When the data Data having a high voltage level is supplied to the data driving circuit 129 by an external system, circuit elements corresponding to the high voltage level are needed so that production cost is increased. However, according to an embodiment of the present invention, even though the external system supplies the data Data having a low voltage level to the data driving circuit 129, the level shifter part 260 increases the voltage level of the data Data to a high level, and thus additional circuit elements corresponding to the high voltage level are not needed, thereby reducing the corresponding production cost. In this case, the level shifter part 260 comprises j level shifters 2601 thru 260*j*.

Figure 7:
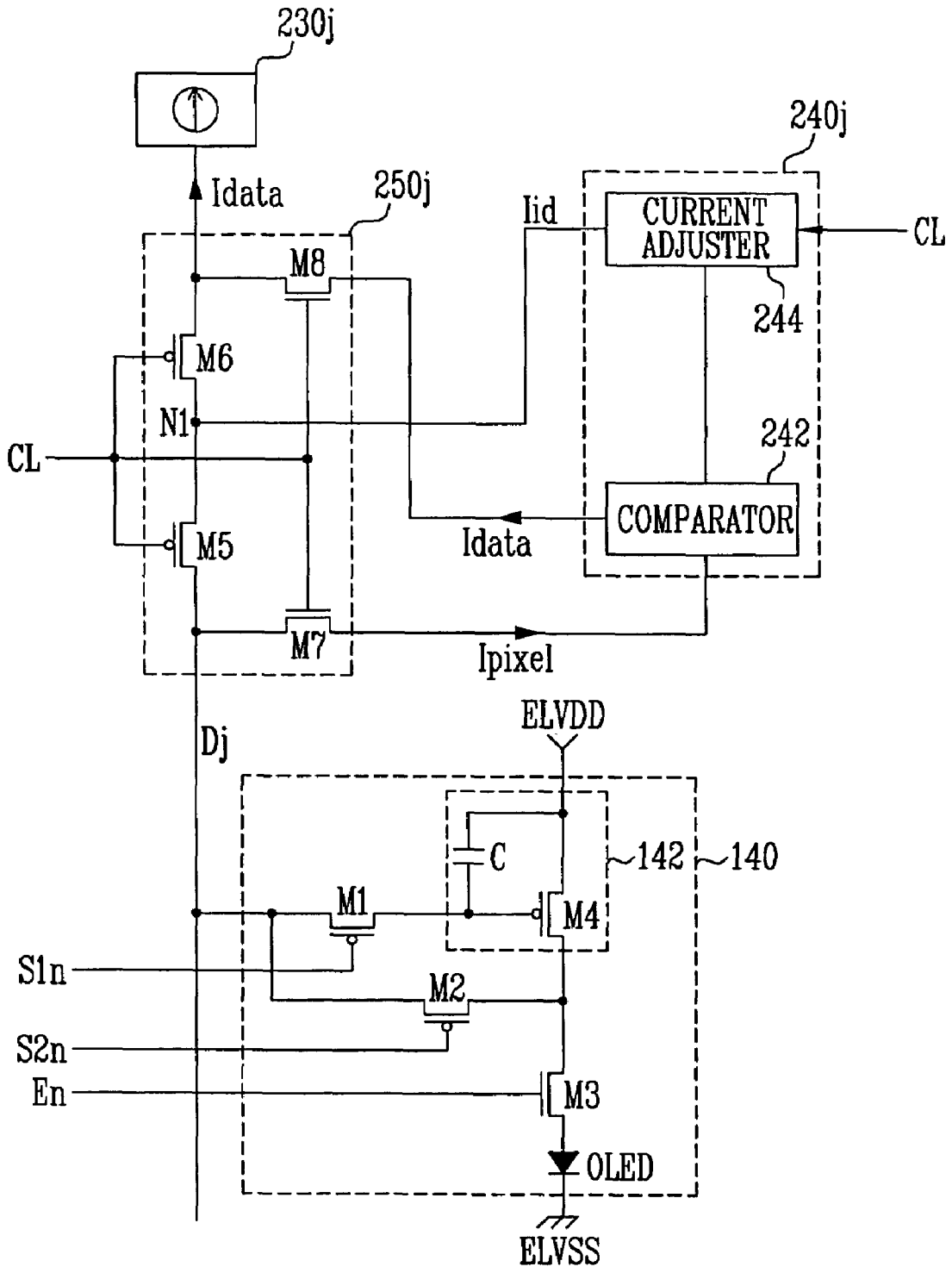
FIG. 7 is a circuit diagram of the current controller and the selector illustrated in FIG. 5.

FIG. 7 is a circuit diagram including the current controller and the selector illustrated in FIG. 5. For the sake of convenience, FIG. 7 illustrates in exemplary fashion the jth current controller 240*j* and the jth selector 250*j*.

Referring to FIG. 7, the selector 250*j* comprises: a fifth transistor M5 and a sixth transistor M6 connected between the current generator 230*j* and the data line Dj; a seventh transistor M7 connected between the data line Dj and the current controller 240*j*; and an eighth transistor M8 connected between the current controller 240*j* and the current generator 230*j*.

The fifth transistor M5 and the sixth transistor M6 are turned on at the same time, and connect the data line Dj to the current generator 230*j*. The fifth transistor M5 and the sixth transistor M6 are controlled by a selection signal supplied by a control line CL.

The seventh transistor M7 and the eighth transistor M8 are controlled by the selection signal supplied by the control line CL, and are thereby turned on and off alternately with the fifth transistor M5. Thus, the seventh transistor M7 and the eighth transistor M8 are different in conductive type from the fifth transistor M5. When the seventh transistor M7 is turned on, the data line Dj is connected to the current controller 240*j*. Furthermore, when the eighth transistor M8 is turned on, the current controller 240*j* is connected to the current generator.

Figure 8:
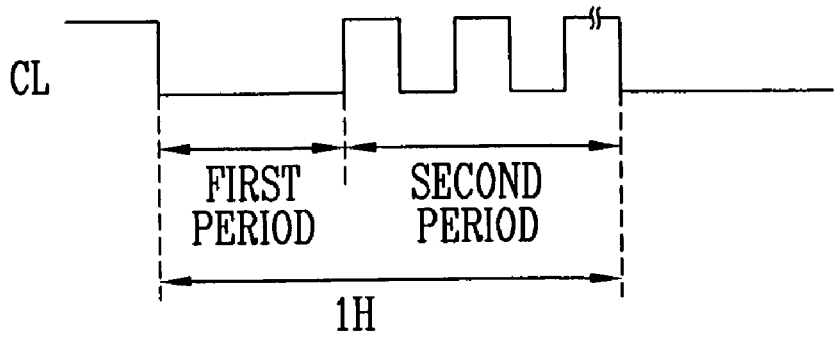
FIG. 8 shows a waveform of a selection signal supplied to the selector illustrated in FIG. 7.

FIG. 8 shows a waveform of a selection signal supplied to the selector illustrated in FIG. 7.

As shown in FIG. 8, the selection signal is supplied during the first period of the horizontal period, and turns on the fifth and sixth transistors M5 and M6. Furthermore, the selection signal is supplied so as to turn on the fifth transistor M5 and sixth transistor M6 alternately with the seventh transistor M7 and eighth transistor M8 during the second period. Also, the selection signal is supplied so as to turn on and off the fifth transistor M5 and the sixth transistor M6 in accordance with the first transistor M1 during the second period.

The current generator 230*j* is configured as a current sink type. That is, the current generator 230*j* receives a current as high as the gradation current Idata corresponding to data Data from the outside (pixel 140) or the current controller 240*j*.

The current controller 240*j* comprises a comparator 242 and a current adjuster 244. The comparator 242 receives the gradation current Idata flowing toward the current generator 230*j* and receives the pixel current Ipixel from the pixel 140. The comparator 242 compares the pixel current Ipixel and the gradation current Idata, and supplies a control signal corresponding to a comparison result to the current adjuster 244. For example, the comparator 242 generates a first control signal when the gradation current Idata is higher than the pixel current Ipixel. Furthermore, the comparator 242 generates a second control signal when the gradation current Idata is lower than the pixel current Ipixel.

The current adjuster 244 controls a current applied to a first node N1 (common node) between the fifth transistor M5 and the sixth transistor M6 on the basis of the control signal supplied by the comparator 242. Then, the current supplied to the pixel 140 is increased or decreased, thereby changing a voltage to be charged in the capacitor C of the driver 142. In this regard, the current adjuster 244 controls the current supplied to the pixel 140 so that the pixel current Ipixel is approximately equal to the gradation current Idata.

Referring to FIGS. 4, 7 and 8, the data driving circuit according to an embodiment of the present invention operates as follows. First, the first and second transistors M1 and M2 respectively, are turned on by the first and second scan signals during the first period of a predetermined horizontal period. During the first period of the horizontal period, the fifth transistor M5 and the sixth transistor M6 are turned on. As the first, second, fifth and sixth transistors M1, M2, M5 and M6, respectively, are turned on, the current generator 230*j* is electrically connected to the pixel 140, thereby supplying the current corresponding to the gradation current Idata from the pixel 140 to the current generator 230*j*. At this point, the capacitor C of the pixel 140 is charged with a predetermined voltage corresponding to the gradation current Idata. Substantially, the first period is set to have a period sufficient to cause the capacitor C of the pixel 140 to be charged with a voltage corresponding to the gradation current Idata.

After the capacitor C of the pixel 140 is charged to a predetermined voltage, the fifth and sixth transistors M5 and M6, respectively, are turned off and the seventh and eighth transistors M7 and M8, respectively, are turned on by the selection signals at the beginning of the second period. Furthermore, at the beginning of the second period, the first transistor M1 is turned off. As the seventh transistor M7 is turned on, the pixel current Ipixel flows from the pixel 140 to the comparator 242 via the second and seventh transistors M2 and M7, respectively. As the eighth transistor M8 is turned on, the current corresponding to the gradation current Idata is supplied from the comparator 242 to the current generator 230*j*. At this point, the comparator 242 compares the gradation current Idata to the pixel current Ipixel, and supplies a control signal corresponding to the comparison result to the current adjuster 244.

The current adjuster 244 supplies the current to the first node N1 or receives the current from the first node on the basis of the comparison result of the comparator 244. That is, the comparator 242 increases or decreases the current applied to the first node N1 on the basis of its comparison result. In this regard, the current adjuster 244 increases or decreases the current applied to the first node N1 so that the pixel current Ipixel is approximately equal to the gradation current Idata.

Then, the seventh and eighth transistors M7 and M8, respectively, are turned off and the fifth and sixth transistors M5 and M6, respectively, are turned on by the selection signals. Furthermore, the first transistor M1 is turned on by the first scan signal. In this case, the first, second, fifth, and sixth transistors M1, M2, M5 and M6, respectively, are turned on, so that a predetermined current is supplied by the pixel 140 to the first node N1.

In the latter regard, the current supplied by the pixel 140 to the first node N1 is controlled by a current increased or decreased by the current adjuster 244. For example, when the current adjuster 244 supplies a predetermined current Iid to the first node N1, the pixel current Ipixel supplied by the pixel 140 to the first node N1 is determined to be a current obtained by subtracting the predetermined current Iid from the gradation current Idata. That is, the pixel current Ipixel, lower than that in the first period, is supplied by the pixel 140, and thus the voltage to be charged in the capacitor C varies correspondingly.

Furthermore, when the predetermined current Iid is supplied by the first node N1 to the current adjuster 244, the pixel current Ipixel supplied by the pixel 140 to the first node N1 is determined to be a current obtained by adding the predetermined current Iid to the gradation current Idata. That is, the pixel current Ipixel, higher than that in the first period, is supplied by the pixel 140, and thus the voltage to be charged in the capacitor C varies correspondingly.

According to an embodiment of the present invention, the first transistor M1 is substantially turned on and off at least once during the second period so that the gradation current Idata is similar or equal to the pixel current Ipixel. Furthermore, the fifth and sixth transistors M5 and M6, respectively, are turned on and off like the first transistor M1, and the seventh and eighth transistors M7 and M8, respectively, are turned on and off alternately with the first transistor M1. According to an embodiment of the present invention, this process is repeated predetermined number of times, thereby controlling a desired pixel current Ipixel so as to flow in the pixel 140.

Figure 9:
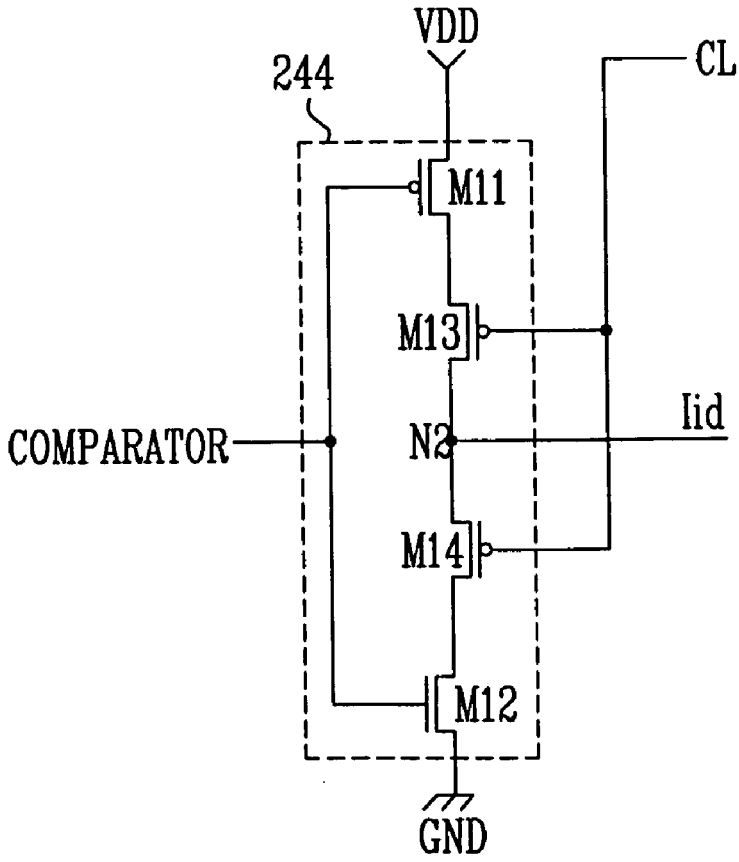
FIG. 9 is a detailed circuit diagram of the current adjuster illustrated in FIG. 7.

FIG. 9 is a detailed circuit diagram of the current adjuster illustrated in FIG. 7.

Referring to FIG. 9, the current adjuster 244 according to an embodiment of the present invention comprises a first transistor M11 and a second transistor M12, which are connected between a constant voltage source VDD and a ground voltage source GND. The first transistor M11 and the second transistor M12 are different in a conductive type from each other. Thus, either the first or second transistor M11 or M12, respectively, is turned on by the control signal transmitted by the comparator 242. When the first transistor M11 is turned on, a predetermined current Iid is supplied by a second node N2 to the first node N1. On the other hand, when the second transistor M12 is turned on, the predetermined current Iid is supplied by the first node N1 to the second node N2.

Furthermore, the current adjuster 244 comprises a third transistor M13 and a fourth transistor M14, which are connected between the first and second transistors M11 and M12, respectively. The third transistor M13 and the fourth transistor M14 are controlled by the selection signal supplied through the control line CL, as shown in FIG. 8. That is, the third transistor M13 and the fourth transistor M14 are turned on and off like the fifth and sixth transistors M15 and M16, respectively.

Figure 10:
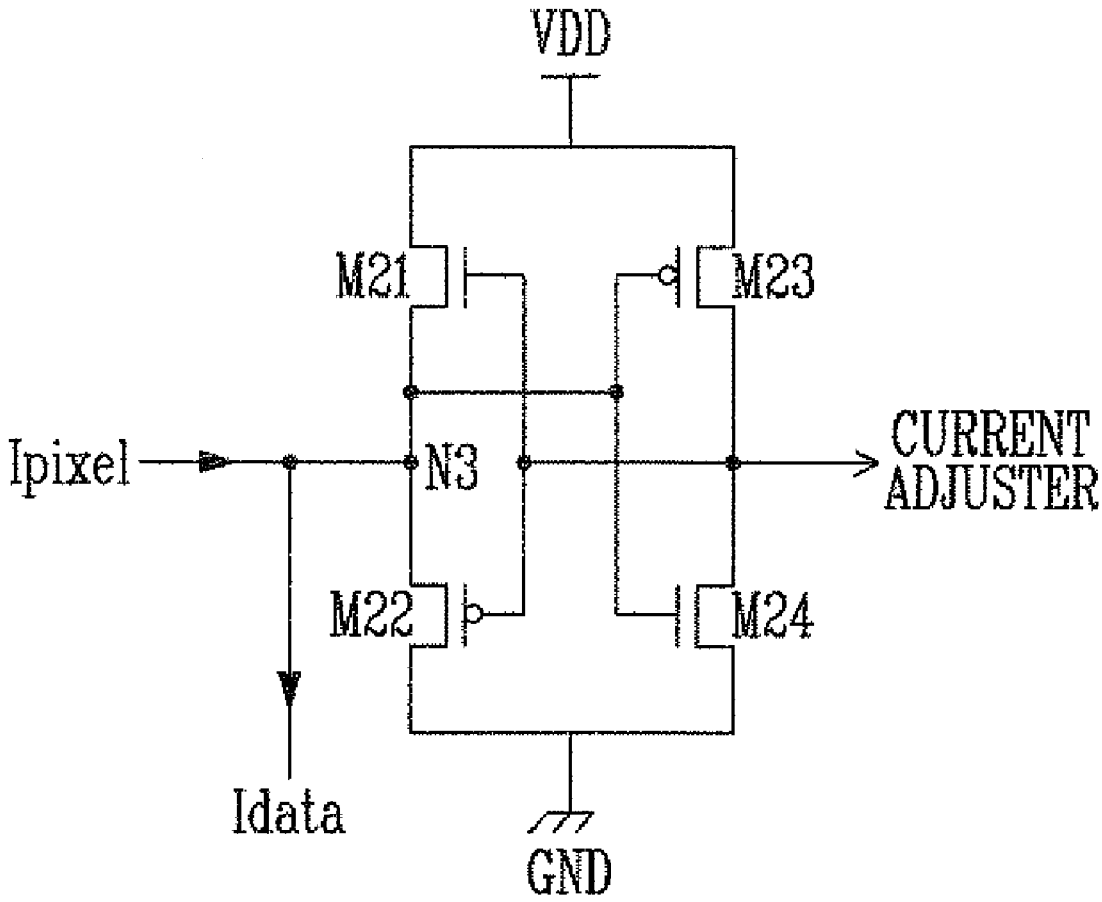
FIG. 10 (Prior Art)
FIG. 10 is a detailed circuit diagram of the comparator illustrated in FIG. 7.

FIG. 10 is a detailed circuit diagram of the comparator illustrated in FIG. 7. The comparator illustrated in FIG. 10 was disclosed by the Institute of Electrical and Electronics Engineers (IEEE) in 1992. However, the comparator according to an embodiment of the present invention is not limited to that proposed by the IEEE. Alternatively, various well-known comparators may be used in the present invention as long as they can compare the currents.

Referring to FIG. 10, a current corresponding to the difference between the pixel current Ipixel and the gradation current Idata is supplied to a third node N3. The current supplied to the third node N3 is supplied to gate terminals of third and fourth transistors M23 and M24, respectively, formed as an inverter. Then, either the third transistor M23 or the fourth transistor M24 is turned on, thereby applying a high voltage VDD or a low voltage GND to an output terminal. The voltage applied to the output terminal is supplied to the gate terminals of first and second transistors M21 and M22, respectively, thereby stably maintaining the voltage applied to the output terminal.

As described above, the present invention provides a data driving circuit for displaying an image with desired brightness, an organic light emitting diode display using the same, and a method of driving the organic light emitting diode display, in which a gradation current corresponding to data is compared to a pixel current flowing in a pixel, and a current to be supplied to the pixel is controlled on the basis of a comparison result so that the pixel current is approximately equal to the gradation current. Consequently, the present invention controls a desired pixel current so as to flow in the pixel, and thus an image is displayed with a desired brightness.

Although embodiments of the present invention have been shown and described, it will be appreciated by those skilled in the art that changes may be made to the disclosed embodiments without departing from the principles and spirit of the invention, the scope of which is defined in the claims and their equivalents.

What is claimed is:

1. A data driving circuit, comprising:

a current digital-analog converter for generating a gradation current corresponding to external data, and for receiving a first current corresponding to the gradation current from a pixel via a data line;

a current control unit for receiving a pixel current from the pixel via the data line, and for selectively increasing and decreasing a level of the first current in accordance with the received pixel current; and a selection unit for selectively connecting the data line with one of the current digital-analog converter and the current control unit.

2. The data driving circuit according to claim 1, wherein the selection unit connects the data line to the current digital-analog converter during a first period of a horizontal period, and alternately connects the data line between the current digital-analog converter and the current control unit during a second period of the horizontal period excluding the first period.

3. The data driving circuit according to claim 2, wherein the selection unit connects the current control unit to the current digital-analog converter when the data line is connected to the current control unit.

4. The data driving circuit according to claim 3, wherein the selection unit comprises a plurality of selectors, each selector comprising:

first and second transistors connected between the data line and the current digital-analog converter;

a third transistor connected between the data line and the current control unit; and a fourth transistor connected between the current control unit and the current digital-analog converter.

5. The data driving circuit according to claim 4, wherein, during the first period, the first and second transistors are turned on, and the third and fourth transistors are turned off.

6. The data driving circuit according to claim 5, wherein, during the second period, the third and fourth transistors are turned off when the first and second transistors are turned on, and the first and second transistors are turned off when the third and fourth transistors are turned on.

7. The data driving circuit according to claim 6, wherein the first current flows in the pixel when the first and second transistors are turned on during the first period, and a current selectively increased and decreased from the first current flows in the pixel when the first and second transistors are turned on during the second period.

8. The data driving circuit according to claim 6, wherein, during the second period, the pixel current is supplied to the current control unit when the third transistor is turned on, and the gradation current is supplied by the current control unit to the current digital-analog converter when the fourth transistor is turned on.

9. The data driving circuit according to claim 4, wherein the current control unit comprises a plurality of current controllers, each current controller comprising:

a comparator for comparing the gradation current with the pixel current; and a current adjuster for selectively increasing and decreasing the level of the first current based on control by the comparator.

10. The data driving circuit according to claim 9, wherein the current adjuster selectively increases and decreases the level of the first current based on a control signal supplied by the comparator, and equalizes the pixel current with the gradation current.

11. The data driving circuit according to claim 10, wherein the current adjuster is connected between a predetermined voltage source and a ground voltage source, and comprises a fifth transistor and a sixth transistor controlled by the control signal supplied by the comparator.

12. The data driving circuit according to claim 11, wherein the fifth transistor and the sixth transistor are different in conductive type from each other.

13. The data driving circuit according to claim 12, further comprising seventh and eighth transistors connected between the fifth transistor and the sixth transistors, and turned on and off at the same time as the first transistor.

14. The data driving circuit according to claim 1, wherein the current digital-analog converter comprises a current sink type device which receives a current as high as the gradation current from the pixel.

15. The data driving circuit according to claim 1, further comprising:

a shift register part for generating sampling signals in sequence; and a latch part for storing data corresponding to the sampling signals, and for supplying the stored data to the current digital-analog converter.

16. The data driving circuit according to claim 15, wherein the latch part comprises:

a sampling latch for sequentially storing the data corresponding to the sampling signals; and a holding latch for storing the data stored in the sampling latch and, at the same time, supplying the stored data to the current digital-analog converter.

17. The data driving circuit according to claim 16, further comprising a level shifter part for increasing a voltage of the data stored in the holding latch, and for supplying the increased voltage to the current digital-analog converter.

18. An organic light emitting diode display, comprising:

a plurality of first and second scan lines;

a plurality of data lines intersecting the first and second scan lines;

a pixel portion including a plurality of pixels connected to the first and second scan lines and the data line;

a scan driver for supplying first and second scan signals to the first and second scan lines, respectively; and a data driver connected to the data line for receiving a first current corresponding to a gradation current as a data signal from the pixels;

wherein the data driver receives a pixel current flowing in each pixel corresponding to the first current, and selectively increases and decreases a level of the first current in accordance with the received pixel current.

19. The organic light emitting diode display according to claim 18, wherein each pixel comprises:

a light emitting device;

a driver for generating the pixel current corresponding to the first current;

a first transistor connected between the driver and a respective one of the data lines, and controlled by a first scan signal supplied through a respective one of the first scan lines; and a second transistor connected between a respective one of the data lines and a common node formed between the driver and the light emitting device, and controlled by a second scan signal supplied through a respective one of the second scan lines.

20. The organic light emitting diode display according to claim 19, wherein the first transistor is turned on in correspondence to the first scan signal during a first period of a predetermined horizontal period, and turned on and off at least once during a second period of the horizontal period excluding the first period.

21. The organic light emitting diode display according to claim 20, wherein the second transistor is turned on in correspondence to the second scan signal for the predetermined horizontal period.

22. The organic light emitting diode display according to claim 20, further comprising a third transistor connected between the driver and the light emitting device, said third transistor being turned off for the predetermined horizontal period and turned on during another period in correspondence to an emission control signal supplied through an emission control line.

23. The organic light emitting diode display according to claim 20, wherein the data driver comprises at least one data driving circuit, said data driving circuit comprising:

a current digital-analog converter for generating a gradation current corresponding to external data, and for receiving the first current in correspondence to the gradation current from the pixel via a respective one of the data lines;

a current control unit for receiving a pixel current from the pixel, and for selectively increasing and decreasing a level of the first current in accordance with the received pixel current; and a selection unit for selectively connecting said respective one of the data lines to one of the current digital-analog converter and the current control unit.

24. The organic light emitting diode display according to claim 23, wherein the selection unit comprises a plurality of selectors, each selector comprising:

third and fourth transistors connected between a respective one of the data lines and the current digital-analog converter;

a fifth transistor connected between a respective one of said data lines and the current control unit; and a sixth transistor connected between the current control unit and the current digital-analog converter.

25. The organic light emitting diode display according to claim 24, wherein the third and fourth transistors are turned on and off like the first transistor.

26. The organic light emitting diode display according to claim 24, wherein the fifth and sixth transistors are turned on and off alternately with the first transistor.

27. The organic light emitting diode display according to claim 23, wherein the current control unit comprises a plurality of current controllers, each current controller comprising:

a comparator for comparing the gradation current with the pixel current; and a current adjuster for selectively increasing and decreasing the level of the first current based on control by the comparator.

28. The organic light emitting diode display according to claim 27, wherein the current adjuster selectively increases and decreases the level of the first current based on a control signal supplied by the comparator, and equalizes the pixel current with the gradation current.

29. The organic light emitting diode display according to claim 23, wherein each data driving circuit comprises:

a shift register part for generating sampling signals in sequence; and a latch part for storing the data corresponding to the sampling signals, and for supplying the stored data to the current digital-analog converter.

30. The organic light emitting diode display according to claim 29, wherein the latch part comprises:

a sampling latch for sequentially storing the data corresponding to the sampling signal;

a holding latch for storing the data stored in the sampling latch and, at the same time, supplying the stored data to the current digital-analog converter.

31. The organic light emitting diode display according to claim 30, further comprising a level shifter part for increasing a voltage of the data stored in the holding latch, and for supplying the increased voltage to the current digital-analog converter.

32. A method of driving an organic light emitting diode display, comprising the steps of:

(a) generating a gradation current corresponding to data;

(b) receiving a first current corresponding to the gradation current from a pixel;

(c) receiving a pixel current corresponding to the first current from the pixel;

(d) comparing the gradation current to the pixel current to obtain a comparison result; and (e) selectively increasing and decreasing a level of the first current based on the comparison result.

33. The method according to claim 32, further comprising:

(f) receiving from the pixel the first current selectively increased and decreased in step (e); and (g) receiving from the pixel a pixel current corresponding to the selectively increased and decreased first current.

34. The method according to claim 33, wherein steps (d) thru (g) are repeated at least once.

35. The method according to claim 32, wherein, in step (e), the first current is selectively increased and decreased to equalize the pixel current with the gradation current.

36. A method of driving an organic light emitting diode display, comprising the steps of:

(a) generating a gradation current corresponding to data;

(b) receiving a first current corresponding to the gradation current from a pixel during a first period;

(c) receiving a pixel current corresponding to the first current from the pixel during a second period excluding the first period;

(d) comparing the gradation current to the pixel current to obtain a comparison result; and (e) selectively increasing and decreasing a level of the first current based on the comparison result.

37. The method according to claim 36, further comprising:

(f) receiving from the pixel the first current selectively increased and decreased in step (e); and (g) receiving from the pixel a pixel current corresponding to the selectively increased and decreased first current.

38. The method according to claim 37, wherein steps (d) thru (g) are repeated at least once during the second period.

39. The method according to claim 36, wherein, in step (e), the first current is selectively increased and decreased to equalize the pixel current with the gradation current.

* * * * *

UNITED STATES PATENT AND TRADEMARK OFFICE

CERTIFICATE OF CORRECTION

PATENT NO. : 7,663,616 B2
APPLICATION NO. : 11/313804
DATED : February 16, 2010
INVENTOR(S) : Choi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1090 days.

Signed and Sealed this

Thirtieth Day of November, 2010

David J. Kappos

David J. Kappos
*Director of the United States Patent and Trademark Office*